US005676289A

United States Patent [19]

Gross et al.

[11] Patent Number: 5,676,289

[45] Date of Patent: Oct. 14, 1997

[54] VALVE-CONTROLLED DISPENSING CLOSURE WITH DISPERSION BAFFLE

[75] Inventors: Richard A. Gross, Oconomowoc; Bruce M. Mueller, Brookfield, both of Wis.

[73] Assignee: AptarGroup, Inc., Crystal Lake, Ill.

[21] Appl. No.: 627,468

[22] Filed: Apr. 4, 1996

[51] Int. Cl.[6] ..... B65D 5/72

[52] U.S. Cl. ..... 222/494; 222/212; 222/547; 222/565; 222/575

[58] Field of Search ..... 222/212, 545, 222/494, 547, 565, 575, 464.1; 239/553, 553.5, 590, 590.5, 602

[56] References Cited

U.S. PATENT DOCUMENTS

| | | | |
|---|---|---|---|
| 2,441,649 | 5/1948 | Sprague | 222/575 X |
| 3,474,936 | 10/1969 | McDonnell | 222/212 X |
| 4,998,674 | 3/1991 | Torra | 239/553.5 X |
| 5,271,531 | 12/1993 | Rohr et al. . | |
| 5,429,282 | 7/1995 | Stebick | 222/547 X |
| 5,439,143 | 8/1995 | Brown et al. . | |

OTHER PUBLICATIONS

U.S. patent application Ser. No. 08/258,659, filed Jun. 10, 1994.

U.S. patent application Ser. No. 08/565,821, filed Dec. 1, 1995.

*Primary Examiner*—Gregory L. Huson

*Attorney, Agent, or Firm*—Dressler, Rockey, Milnamow & Katz, Ltd.

[57] ABSTRACT

A closure is provided for a container having an opening. The closure includes a base for mounting to the container around the opening. A dispensing valve is disposed across the base and defines an orifice which opens to permit flow therethrough in response to increased pressure within the container and closes to shut off flow therethrough upon removal of the increased pressure. A dispersion baffle is included on the base outwardly of the valve. The baffle defines a plurality of dispensing apertures.

17 Claims, 6 Drawing Sheets

VALVE-CONTROLLED DISPENSING CLOSURE WITH DISPERSION BAFFLE

TECHNICAL FIELD

This invention relates to container closures. The invention is more particularly related to a dispensing closure for use with a squeeze-type container wherein the dispensing closure has a valve which opens to dispense a product from the container when the container is squeezed and which automatically closes when the squeezing pressure is released.

BACKGROUND OF THE INVENTION AND TECHNICAL PROBLEMS POSED BY THE PRIOR ART

Fine powder (e.g., body powder or cosmetic powder) may be conventionally packaged in a container having a dispensing closure which includes a container cover defining a plurality of dispensing apertures or openings. A solid cap or lid is typically provided for being releasably secured to the cover for occluding the dispensing openings when the container is not in use. This prevents spillage if the container is dropped or tipped over. The cap may also help keep the contents fresh and may reduce the ingress of contaminants.

The inventors of the present invention have discovered that it would be advantageous to provide an improved system for dispensing a product, especially powder. In particular, it would be desirable to provide a powder dispensing system which would not require the use of a reclosable lid to prevent spillage if the container is inadvertently tipped over. It would also be desirable to provide an improved dispensing system that would eliminate or minimize contaminant ingress even if no lid is placed on the container.

A variety of packages, including dispensing containers, have been developed for personal care products which are in liquid form (e.g., shampoo, lotions, etc.). One type of closure for these kinds of containers includes a flexible, self-closing, slit-type dispensing valve mounted over the container opening. The valve has a slit or slits which define a normally closed orifice that opens to permit fluid flow therethrough in response to increased pressure within the container when the container is squeezed. The valve automatically closes to shut off fluid flow therethrough upon removal of the increased pressure.

Designs of closures using such valves are illustrated in the U.S. Pat. No. 5,271,531. Typically, the closure includes a base mounted on the container neck to define a seat for receiving the valve and includes a retaining ring or housing structure for holding the valve on the seat in the base.

The closure can be provided with a hinged lid for covering the valve during shipping or when the container is packed for travel (or when the container is otherwise not in use). See, for example, FIGS. 31–34 of U.S. Pat. No. 5,271,531. The lid can keep the valve clean and/or protect the valve from damage.

It would be desirable, however, to provide an improved closure system that could be even more conveniently used with a dispensing valve and that, in suitable applications, eliminates the need to always use an exterior lid.

The inventors of the present invention have discovered that the use of such a valve to dispense fluid and non-fluid materials (e.g., powders) can provide advantages in some applications. However, the inventors have also discovered that the dispensing of some materials (e.g., powder) through a valve in a closure may result in discharge that lacks desirable distribution pattern characteristics and/or desirable mass flow characteristics. Therefore, it would be beneficial to provide a valve dispensing system for materials, especially powders, wherein desirable distribution patterns and discharge quantities can be readily obtained.

Additionally, it would be beneficial if the closure components could be provided with an improved system for readily accommodating the assembly of the components during manufacture of the closure.

Also, it would be desirable if such an improved closure could be provided with a design that would accommodate efficient, high quality, large volume manufacturing techniques with a reduced product reject rate.

Further, such an improved closure should advantageously accommodate its use with a variety of conventional containers having a variety of conventional container finishes, such as conventional threaded or snap-fit attachment configurations.

The present invention provides an improved closure which can accommodate designs having the above-discussed benefits and features.

SUMMARY OF THE INVENTION

According to the present invention, an improved dispensing closure is provided for an opening to a container interior. The closure employs a dispensing valve. Depending upon the application, the closure may also include a lid.

The dispensing closure is especially suitable for use in dispensing fine powder (e.g., body powder or cosmetic powder). The closure accommodates the dispensing of powder in desirable distribution patterns and at desirable mass flow rates or discharge quantities.

The closure includes a base for mounting to the container around the container opening. A dispensing valve is disposed across the base. The dispensing valve defines an orifice which opens to permit flow therethrough in response to increased pressure within the container and closes to shut off flow therethrough upon removal of the increased pressure. A dispersion baffle on the base outwardly of the valve is provided for controlling the discharge characteristics. The baffle defines a plurality of dispensing apertures.

In a preferred embodiment, the closure also includes a lid hinged for movement between a closed position covering the baffle and an open position in which the baffle is uncovered.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 5 shows, in solid lines, the valve in a an open, dispensing position and shows, in dashed lines, the valve in a closed, non-dispensing position;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure of this invention is described in various positions, and terms such as upper, lower, horizontal, etc., are used with reference to these positions. It will be understood, however, that the closure components may be manufactured and stored in orientations other than the ones described.

Figure 1:
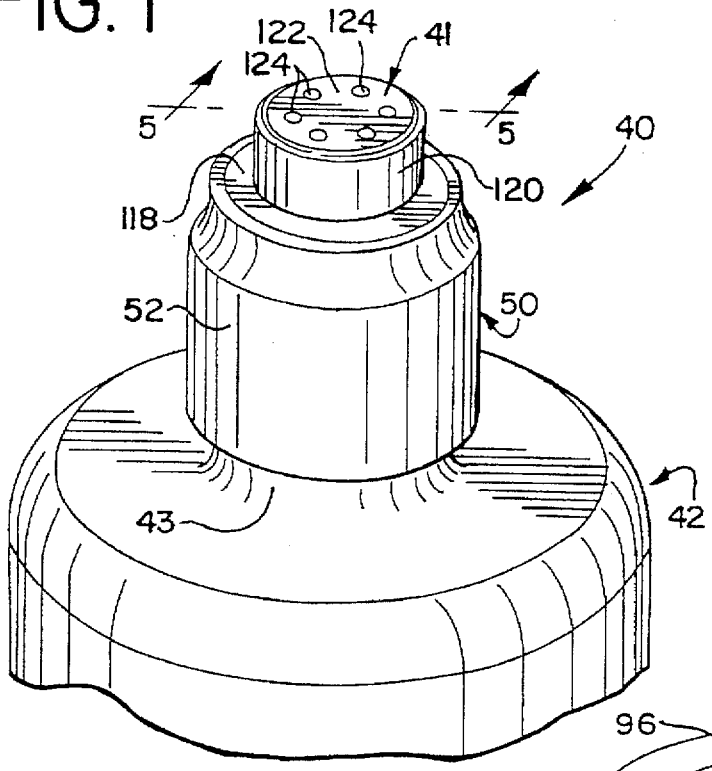
FIG. 1 is a fragmentary, perspective view of a first embodiment of a closure of the present invention shown in place on a container.
Figure 2:
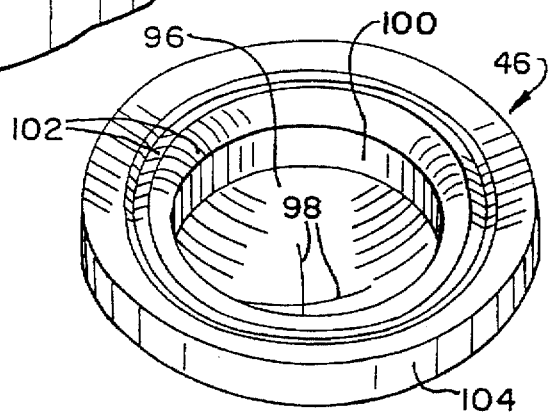
FIG. 2 is a perspective view of the slit valve removed from the closure illustrated in FIG. 1.
Figure 3:
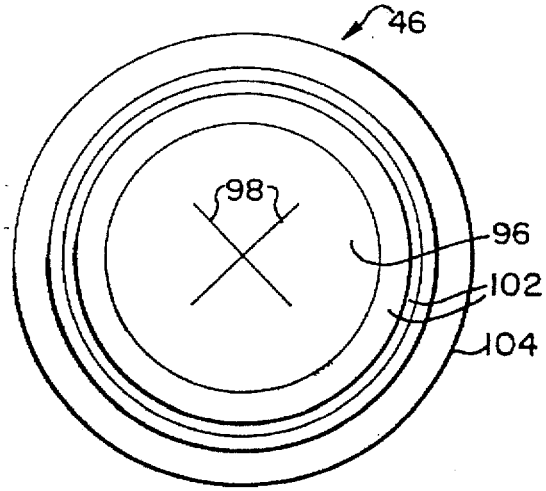
FIG. 3 is a top plan view of the valve shown in FIG. 2.
Figure 4:
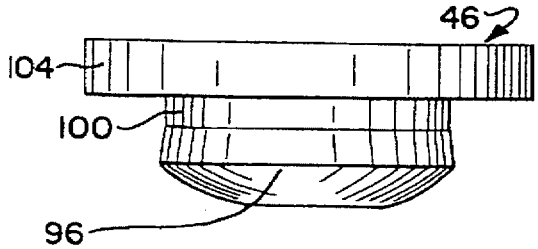
FIG. 4 is a side elevational view of the valve shown in FIG. 2.
Figure 5:
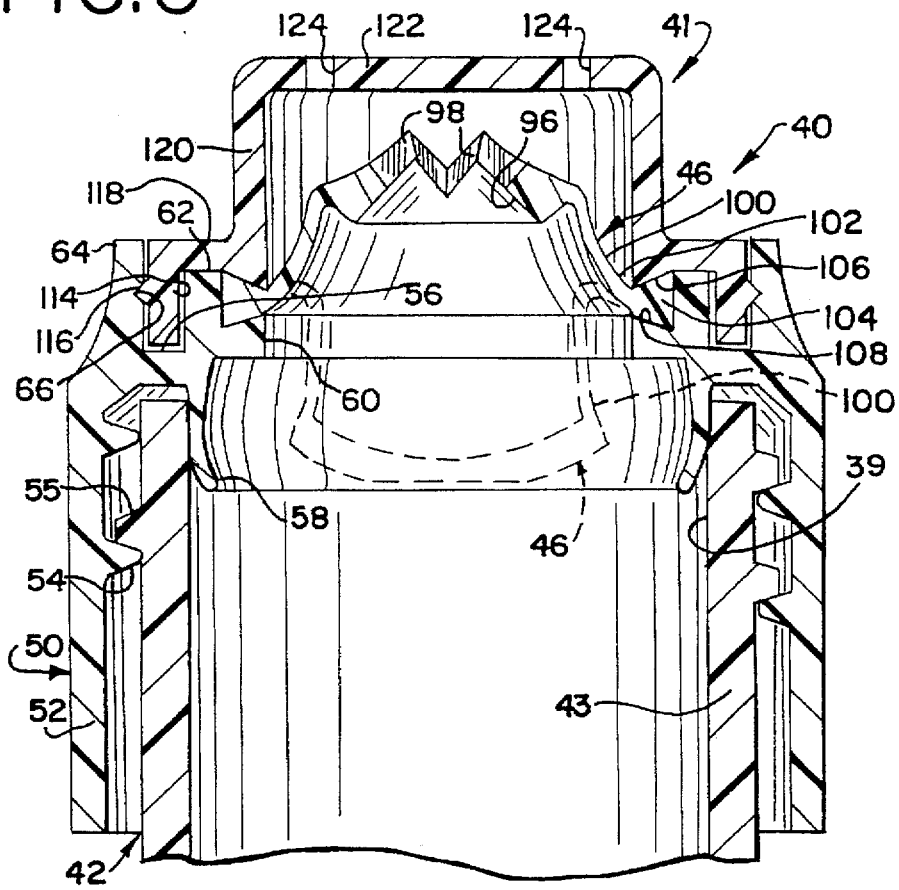
FIG. 5 is a fragmentary, cross-sectional view taken generally along the plane 5—5 in FIG. 1.

With reference to the figures, a first embodiment of a closure of the present invention is illustrated in FIGS. 1–5 and is represented generally in FIGS. 1 and 5 by reference numeral 40. The closure 40 is adapted to be disposed on a container, such as a container 42 (FIGS. 1 and 5) which has a conventional mouth or opening 39 formed by a neck 43 (FIG. 5) or other suitable structure. The neck 43 typically has (but need not have) a circular cross-sectional configuration, and the body of the container 42 may have another cross-sectional configuration, such as an oval cross-sectional shape, for example. The closure 40 may be fabricated from a thermoplastic material, or other materials, compatible with the container contents.

The container 42 may be stored and used in the orientation shown in FIG. 1 wherein the closure 40 is at the top of the container 42. The container 42 may also be normally stored in an inverted position (not illustrated). When stored in the inverted position, the container 42 employs the closure 40 as a support base.

The container 42 is a squeezable container having a flexible wall or walls which can be grasped by the user and compressed to increase the internal pressure within the container so as to squeeze the product out of the container through the closure (as explained in detail hereinafter). The container wall typically has sufficient, inherent resiliency so that when the squeezing forces are removed, the container wall returns to its normal, unstressed shape.

The closure 40 includes a base 50, a dispersion baffle 41, and a valve 46. In the first embodiment illustrated in FIGS. 1 and 5, the body 50 includes an inner annular wall 52 which has a conventional thread 54 or other suitable means (e.g., a conventional snap-fit bead (not illustrated)) for engaging suitable cooperating means, such as a thread 55 on the container neck 43 (FIG. 5) to secure the closure base 50 to the container 42.

Near the top of the annular inner wall 52, the closure base 50 has a transverse deck 56 which extends over the upper, distal end of the container neck 43. The deck 56 has a downwardly extending, annular, flexible seal 58 which is received against the inner edge of the container neck 43 in the container neck opening 41 so as to provide a leak-tight seal between the closure body deck 56 and the container neck 43.

As illustrated in FIG. 5, the closure body deck 56 defines a discharge aperture 60 over the container neck opening 39. A collar 62 projects upwardly from the closure body deck 56 around the discharge aperture 60. A larger diameter, annular sleeve 64 is disposed outwardly of the collar 62 and projects upwardly from the body deck 56. The sleeve 64 defines an inwardly open, annular groove 66.

In the preferred form of the valve 46 illustrated, the valve 46 is of a known design employing a flexible, resilient material, which can open to dispense product. The valve 46 is preferably fabricated from thermosetting elastomeric materials such as silicone, natural rubber, and the like. It is also contemplated that the valve 46 may be fabricated from thermoplastic elastomers based upon materials such as thermoplastic propylene, ethylene, urethane, and styrene, including their halogenated counterparts. A valve which is similar to, and functionally analogous to, valve 46 is disclosed in the U.S. Pat. No. 5,439,143. However, the valve 46 has a peripheral flange structure (described in detail hereinafter) which differs from the flange structure of the valve shown in the U.S. Pat. No. 5,439,143. The description of the valve disclosed in the U.S. Pat. No. 5,439,143 is incorporated herein by reference to the extent pertinent and to the extent not inconsistent herewith.

As illustrated in FIGS. 2–5, the valve 46 includes a flexible, central wall 96 which has an outwardly concave configuration and which defines at least one, and preferably two, dispensing slits 98 extending through the central wall 96. A preferred form of the valve 46 has two, mutually perpendicular, intersecting slits 98 of equal length. The intersecting slits 98 define four, generally sector-shaped, flaps or petals in the concave, central wall 96. As shown in FIG. 5, the flaps open outwardly from the intersection point of the slits 98 in response to increasing pressure of sufficient magnitude in the well-known manner described in the U.S. Pat. No. 5,439,143.

The valve 46 includes a skirt 100 (FIGS. 2 and 5) which extends outwardly from the valve central wall 96. At the outer (upper) end of the skirt 100 there is a thin, annular flange 102 (FIGS. 2, 3, and 5) which extends peripherally from the skirt 100 in a downwardly angled orientation. The thin flange 102 terminates in an enlarged, much thicker, peripheral flange 104 which has a generally dovetail shaped transverse cross section.

To accommodate the seating of the valve 46 in the closure 40, the underside of the baffle 41 defines an annular, downwardly facing, angled clamping surface 106 for engaging the top of the valve flange 104. The bottom of the valve flange 104 is engaged by an annular shoulder in the base deck 56 which defines an upwardly angled annular seating surface 108.

The spacing between the deck clamping surface 106 and the deck seating surface 108 increases with increasing radial distance from the center of the valve 46. Such a configuration defines an annular cavity with a transverse cross section having a dovetail shape which generally conforms to the cross-sectional shape of the valve flange 104.

This clamping arrangement securely holds the valve 46 in the closure 40 without requiring special internal support structures or bearing members adjacent the interior surface of the valve cylindrical skirt 100. This permits the region adjacent the valve skirt 100 to be substantially open, free, and clear so as to accommodate movement of the valve skirt 100.

When the valve 46 is properly mounted in the closed condition within the closure 40 as illustrated in dashed lines in FIG. 5, the valve 46 is recessed relative to the top of the base 50. However, when the container 42 is squeezed to dispense the contents through the valve 46 (as described in detail in U. S. Pat. No. 5,439,143), then the valve central wall 96 is forced outwardly from its recessed position as illustrated in solid lines in FIG. 5.

The baffle 41 extends over the valve 46. The baffle 41 includes a peripheral mounting flange 114 which is received between the base inner collar 62 and the base outer sleeve 64 as illustrated in FIG. 5. The baffle flange 114 includes an outwardly projecting, annular bead 116 which is received within the annular groove 66 defined in the base sleeve 64. Preferably, the baffle bead 116 and the base groove 66 define a conventional snap-fit engagement for retaining the baffle 41 in position in the base 50 over the valve 46. The snap-fit engagement between the base 50 and baffle 41 maintains the valve flange 104 in a leak-tight clamping engagement between the base 50 and the baffle 41 as illustrated in FIG. 5.

In the first embodiment illustrated in FIGS. 1 and 5, the baffle 41 includes an annular lower deck 118 extending inwardly from the baffle mounting flange 114. The baffle 41 further includes an annular wall 120 extending upwardly from the deck 118 to provide an internal space for accommodating movement of the valve 46 from the retracted, closed position (illustrated in dashed lines in FIG. 5) to the extended, open position (illustrated in solid lines in FIG. 5).

The baffle annular wall 120 terminates at its upper end in a transverse cross wall or outer baffle plate 122. The outer baffle plate 122 defines a plurality of dispensing openings or apertures 124 which are, in the preferred arrangement illustrated, located on a circular locus around a solid, central portion of the outer baffle plate 122.

Preferably, the base 50, valve 46, and baffle 41 each have a generally circular configuration and are aligned along a common longitudinal axis as illustrated in FIGS. 1 and 5. The intersection of the valve slits 98 lies on the longitudinal axis in registry with the center of the circular locus of the baffle apertures 124. The unapertured central portion of the baffle plate 122 within the circular array of apertures 124 has a diameter that is greater than the length of each of the valve slits 98.

In use, the container 42 is squeezed to increase the pressure within the container 42 above ambient. This forces the product within the container 42 toward the valve 46 and forces the valve 46 from the recessed or retracted position (illustrated in dashed lines in FIG. 5) to the extended, open position (illustrated in solid lines in FIG. 5).

When the valve 46 is subjected to an increased container pressure to open the valve, the valve central wall 96 (which contains the slits 98) is displaced outwardly while still maintaining its generally concave configuration. The outward displacement of the concave, central wall 96 is accommodated by the relatively, thin, flexible, skirt 100. The skirt 100 moves from a closed, rest position to the pressurized position wherein the skirt is projecting outwardly toward the outer baffle plate 122.

The valve 46 does not open (i.e., the slits do not open) until the valve central wall 96 has moved substantially all the way to a fully extended position. Indeed, as the valve central wall 96 moves outwardly, the valve central wall 96 is subjected to radially inwardly directed compression forces which tend to further resist opening of the slits 98. Further, the valve central wall 96 generally retains its outwardly concave configuration as it moves forward and even after it reaches the fully extended position. However, if the internal pressure is sufficiently great, then the slits 96 of the valve 46 begin to open to dispense product as illustrated in FIG. 5.

The product is expelled or discharged through the open slits 98. The product, which may be a liquid or a powder, is forced against the inner surface of the outer baffle plate 122 and also through the apertures 124. Some of the discharging product that initially impinges upon the inner surface of the outer baffle plate 122 is forced radially outwardly and then through the apertures 124.

Even when the discharging product is a fine powder, the combination of the valve 46 and baffle 42 provides a desirable discharge pattern and discharge quantity. A desirable dispersion pattern of the fine powder is achieved.

In contrast, it has been found that when the baffle 41 is omitted from the closure, the discharge of certain kinds of fine power through the valve 46 can result in a less desirable discharge. In particular, the fine powder tends to discharge in a stream that moves at too high of a velocity and does not spread out into a desirable pattern. The impact of such a discharging particulate stream (on the user's hand, for example) is undesirably high, and the quantity of product discharged may be too large.

It has been found that the combination of the baffle 41 with the valve 46 reduces the mass flow rate and provides a desirable discharge pattern. The size, shape, number, and pattern of the apertures 124 can be varied as may be desired depending upon the characteristics of the product being dispensed, depending upon the dispensing characteristics of the valve 46, and depending upon the mass flow rate of product that is desired. The initial velocity and volume of product discharging from the valve 46 is generally controlled by the design characteristics of the valve and, of course, by the magnitude of the squeezing force and rate of application of squeezing force to which the container 52 is subjected.

Figure 8:
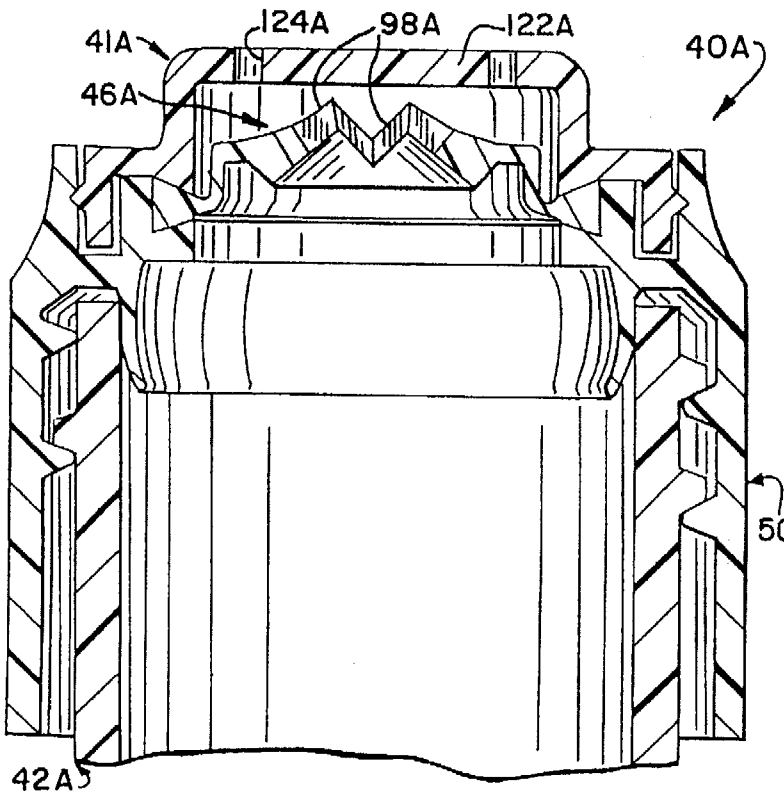
FIG. 8 is a fragmentary, cross-sectional view similar to FIG. 5, but FIG. 8 illustrates a second embodiment of the closure of the present invention employing the modified form of the valve illustrated in FIGS. 6 and 7.

A second embodiment of a closure of the present invention is illustrated in FIG. 8 and is represented generally in FIG. 8 by reference numeral 40A. The closure 40A is adapted to be disposed on a container 42A, and the container 42A may be identical with the flexible container 42 illustrated in FIGS. 1 and 5 and described in detail above.

As with the first embodiment illustrated in FIGS. 1–5, the second embodiment closure and container may be stored and used in the orientation wherein the closure 40A is at the top of the container. The container 42A may also be normally stored in an inverted position (not illustrated). When stored in the inverted position, the container would employ the closure 40A as a support base.

The closure 40A includes a baffle 41A, valve 46A, and base 50A. The closure base 50A may be substantially identical with the base 50 described above with reference to the first embodiment of the closure 40 illustrated in FIGS. 1–5.

Figure 6:
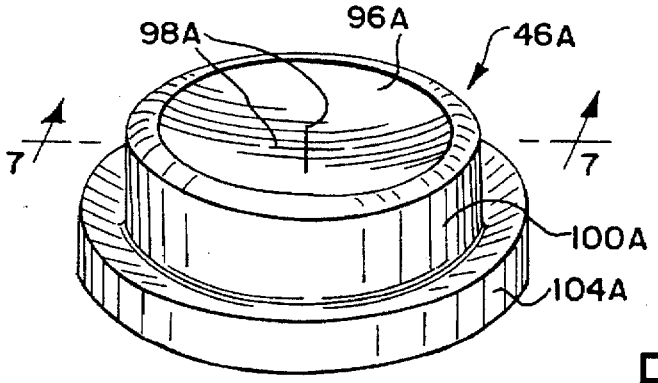
FIG. 6 is a perspective view of another form of a slit valve that can be used in the closure of the present invention.
Figure 7:
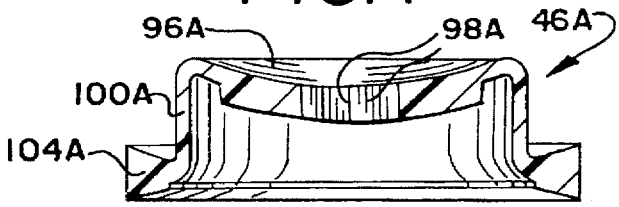
FIG. 7 is a cross-sectional view taken generally along the plane 7—7 in FIG. 6.

The valve 46A is separately illustrated in FIGS. 6 and 7. The valve 46A is generally similar to the valve 70 illustrated in FIGS. 1–5 of the U.S. Pat. No. 5,271,531. The description of that valve disclosed in the U.S. Pat. No. 5,271,531 is incorporated herein by reference thereto to the extent pertinent and to the extent not inconsistent herewith.

The valve 46A includes a flexible, central wall 96A which has an outwardly concave configuration and which defines at least one, and preferably two, dispensing slits 98A extending through the central wall 96A. The valve 46A includes a skirt 100A which extends downwardly from the wall 96A. At the bottom of the skirt 100A, there is a peripheral flange 104A which has a generally dovetail-shaped, transverse cross section.

The valve 46A is mounted within the closure 40A in a generally opposite orientation compared to the mounting of the valve 46 in the first embodiment of the closure illustrated in FIG. 5. That is, with reference to FIG. 8, the valve 46A has a normal, closed condition wherein the valve is positioned generally at the upper end of the base 50A. The valve 46A does not have a recessed or retracted orientation corresponding to the recessed orientation of the first embodiment valve 46 illustrated in dashed lines in FIG. 5. The valve 46A is, however, clamped within the closure in substantially the same manner that the first embodiment valve 46 is clamped within the closure 50 as described above with reference to FIG. 5.

The closure baffle 41A is generally similar to the first embodiment baffle 41 described above with reference to the closure 40 illustrated in FIGS. 1–5. However, the baffle 41A is shorter. That is, the baffle 41A does not project upwardly above the container as high as does the first embodiment baffle 41. The baffle 41A can be shorter because the valve 46A, when it opens (as illustrated in FIG. 8), does not project upwardly as far as does the open valve 46 (FIG. 5). The baffle 41A is maintained in a snap-fit engagement with the base 50A, and the baffle 41A defines a plurality of discharge apertures 124A in an outer baffle plate 122A.

The valve 46A and baffle 41A cooperatively function to provide desirable dispensing characteristics with respect to the product, whether it be liquid or powder, in substantially the same manner as described above with reference to the first embodiment of the closure 40 illustrated in FIGS. 1–5.

Other types of valves, similar to, or different from, the valves 46 and 46A, may also be employed in the closure of the present invention. However, the flexible, slit-type valves 46 and 46A described above have been found to function particularly well with the baffle (41 or 42A) for dispensing product, especially fine powder.

Figure 9:
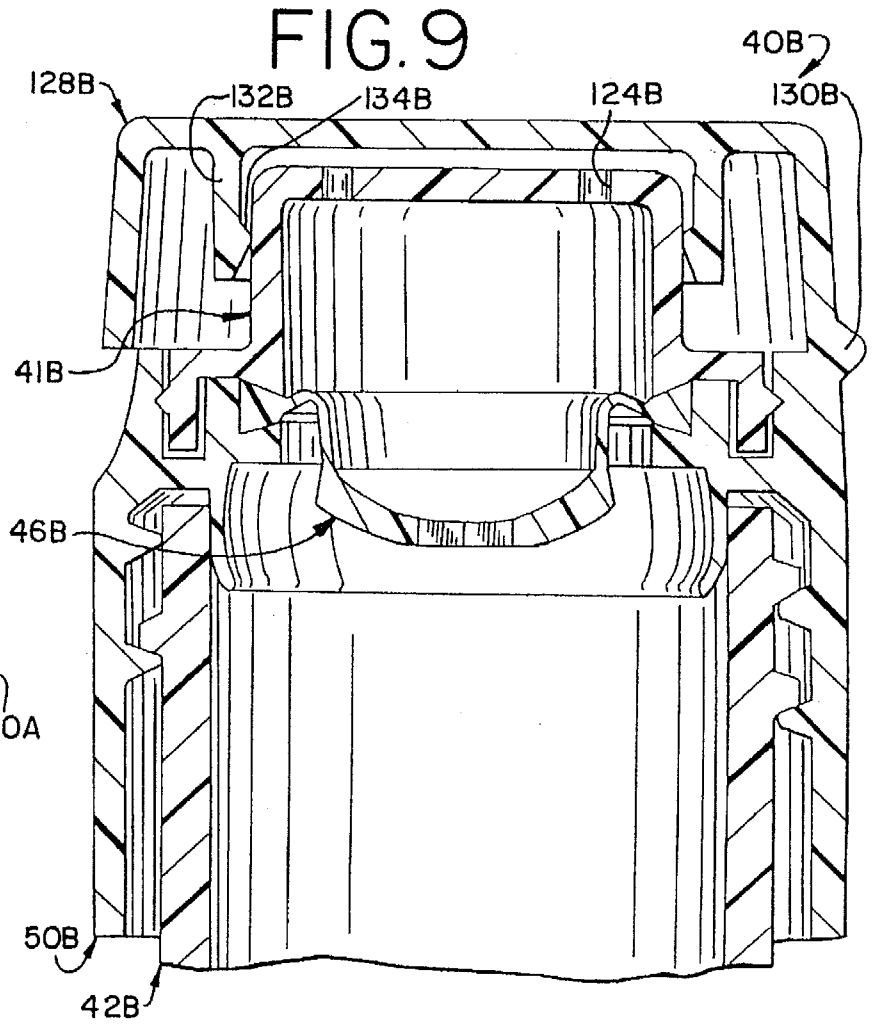
FIG. 9 is a fragmentary, cross-sectional view similar to FIG. 8, but FIG. 9 illustrates a third embodiment of the closure of the present invention wherein the third embodiment of the closure employs a valve of the type illustrated in FIGS. 2–4 and also employs a hinged lid.

A third embodiment of closure of the present invention is illustrated in FIG. 9 and is represented generally in FIG. 9 by reference numeral 40B. The closure 40B includes a base 50B for being mounted to a container 42B and for supporting a valve 46B in clamping engagement by means of a baffle 41B.

In the third embodiment illustrated in FIG. 9, the container 42B, base 50B, baffle 41B, and valve 46B each have structures which are substantially identical with the corresponding structures 42, 50, 41, and 46 described above with reference to the first embodiment illustrated in FIGS. 1–5. The third embodiment of the closure 40B differs only in the addition of a cap or lid 128B.

The lid 128B is preferably molded as a unitary part of the base 50B and is hingedly connected thereto with a flexible hinge strap 130B. The lid 128B includes an inner, annular seal wall 132B with an inwardly projecting seal bead 134B for engaging the exterior surface of the baffle 41B outwardly of the baffle dispensing apertures 124B. Thus, should the container 42B be accidentally squeezed or impacted with sufficient force to effect opening of the flexible valve 46B, the product will be retained within the lid 128B.

When it is desired to dispense product from the container 42B, the lid 128B is lifted upwardly and pivoted about the hinge 130B to an open position. If desired the closure may employ a suitable snap-action, bistable hinge that has a self-maintaining, stable, open position. In some applications, it may be preferable to provide the lid 128B as a separate, movable component that is not directly attached as unitary part of the closure base 50B.

Figure 10:
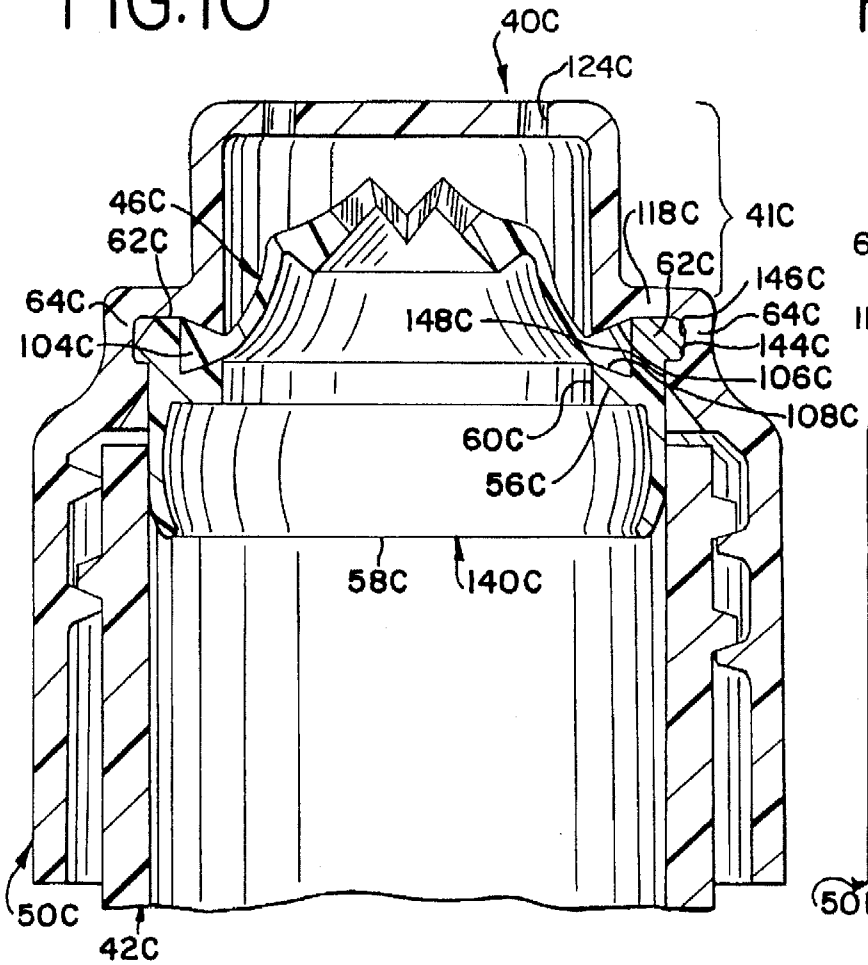
FIG. 10 is a fragmentary, cross-sectional view similar to FIG. 9, but FIG. 10 illustrates a fourth embodiment of the closure employing the valve illustrated in FIGS. 2–4.

A fourth embodiment of the closure of the present invention is illustrated in FIG. 10 and is represented generally in FIG. 10 by reference numeral 40C. The closure 40C includes a base 50C for being mounted to a container 42C and for supporting flange 104C of a valve 46C in clamping engagement by means of a baffle 41C which has dispensing apertures 124C. The valve 46C is identical with, and functions in the same manner as, the first embodiment valve 46 described above with reference to FIGS. 1–5.

In the fourth embodiment illustrated in FIG. 10, the baffle 41C is molded as a unitary part of the closure base 50C. Because the baffle 41C is a unitary part of the base 50C, no snap-fit engagement is required to hold a separate baffle on the closure base. In particular, as illustrated in FIG. 10, the closure base 50C includes an upwardly extending wall 64C which is connected in a unitary manner with an annular deck 118C forming the lower part of the baffle 41C. The portion of the baffle 41C extending upwardly from the deck 118C is substantially identical with the corresponding upper portion of the first embodiment baffle 41 described above with reference to FIGS. 1–5.

Because the baffle 41C is formed as a unitary part of the closure base 50C, means must be provided for accommodating assembly of the components, and in particular, for accommodating placement of the valve 46C. To this end, the valve 46C is maintained in position by means of a separate body 140C which clamps the valve 46C against the baffle 41C. In particular, the body 140C defines a downwardly extending, annular, flexible seal 58C which is generally analogous to the seal 58 described above with reference to the first embodiment closure illustrated in FIGS. 1–5. The seal 58C is received against the upper inner edge of the container 42C to provide a leak-tight seal.

The closure body 140C also has a deck 56C which defines a discharge aperture 60C over the container opening. The upper surface of the deck 56C defines an upwardly angled, annular seating surface 108C for engaging the peripheral flange 104C of the valve 46C and clamping the flange 104C tight against an annular, downwardly facing, angled clamping surface 106C defined by the baffle 41C.

The body 140C includes an upwardly extending annular wall 62C having a radially outwardly projecting rim 144C which is received in an annular recess 146C defined on the inside surface of the base upper wall 64C. The rim 144C engages an annular bead 148C which projects inwardly from the base wall 64C below the recess 146C. A snap-fit engagement is effected between the body rim 144C and the base bead 148C to securely hold the body 140C in place and in clamping engagement with the valve 46C.

The baffle 41C, although it is unitary with the upper end of the face 50C, defines a plurality of dispensing apertures 124C which function in a manner substantially identical with that described above for the first embodiment baffle apertures 124 illustrated in FIGS. 1 and 5.

Figure 11:
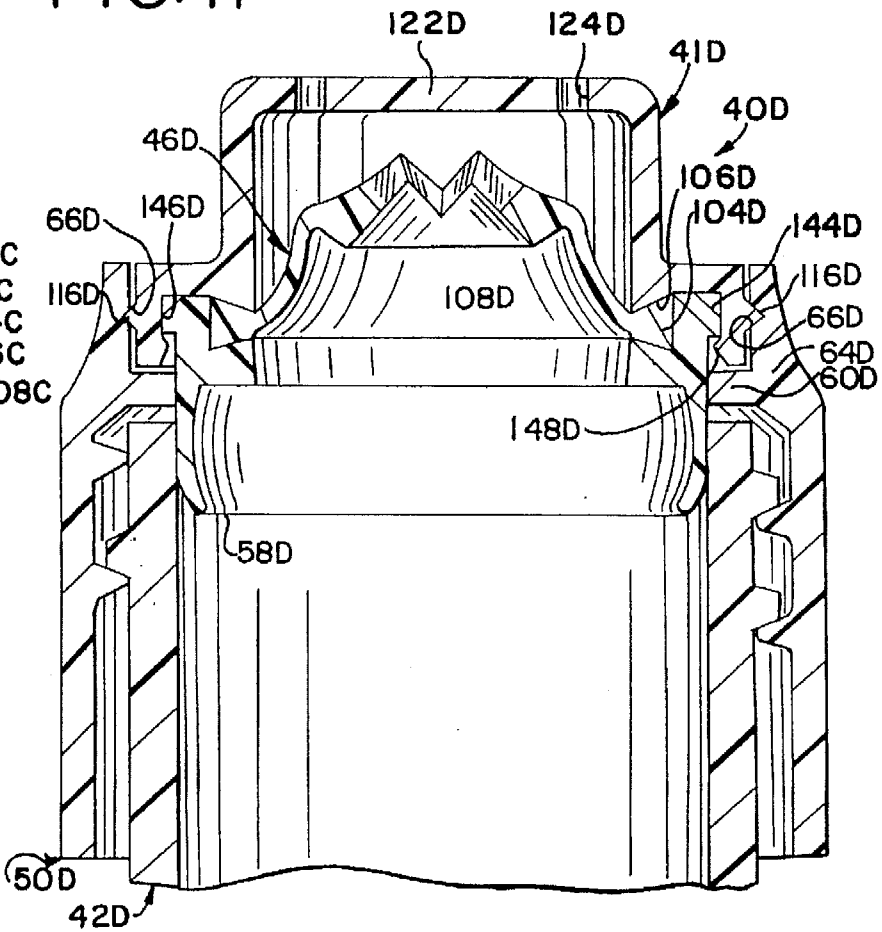
FIG. 11 is a fragmentary, cross-sectional view similar to FIG. 10, but FIG. 11 illustrates a fifth embodiment of the closure employing a cartridge assembly which includes the valve of the type shown in FIGS. 2–4.

A fifth embodiment of closure of the present invention is illustrated in FIGS. 11–16 and is represented generally in FIG. 11 by reference numeral 40D. The closure 40D includes a base 50D for being mounted to a container 42D and for supporting a valve 46D, valve support body 140D, and a baffle 41D.

In the fifth embodiment illustrated in FIG. 11, the container 42D, base 50D, baffle 41D, and valve 46D each have structures which are generally similar to the corresponding structures 42, 50, 41, and 46 described above with reference to the first embodiment illustrated in FIGS. 1–5. The fifth embodiment of the closure 40D differs primarily in that the inner support for the valve 46D is provided separately from the base 50D in the form of the body 140D which together with the baffle 41D and valve 46D defines a cartridge.

The base 50D has an upper annular wall 64D defining an inwardly open, annular groove 66D. An annular flange 60D extends inwardly from the annular wall 64D below the groove 66D and above the upper end of the container 42D. The inner end of the flange 60D defines an annular bead 61D. The above-described structure of the upper portion of the base 50D is adapted to receive and retain the valve support body 140D, baffle 41D, and valve 46D clamped between the body 140D and baffle 41D.

Figure 14:
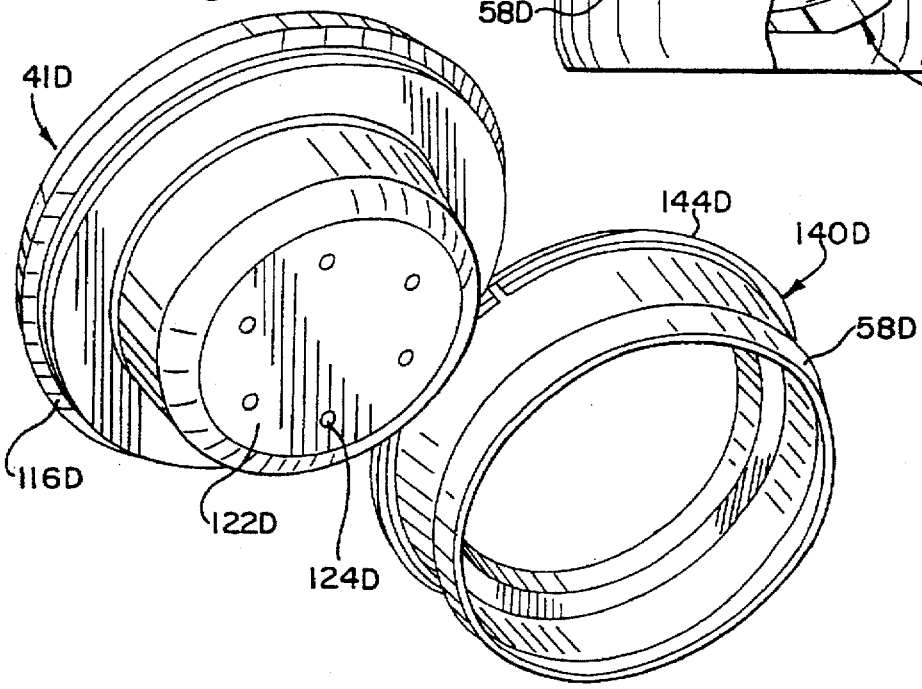
FIG. 14 is a perspective view of the cartridge illustrated in FIGS. 12 and 13, but FIG. 14 shows the cartridge in an opened configuration prior to assembly with the valve and subsequent closing of the cartridge.
Figure 15:
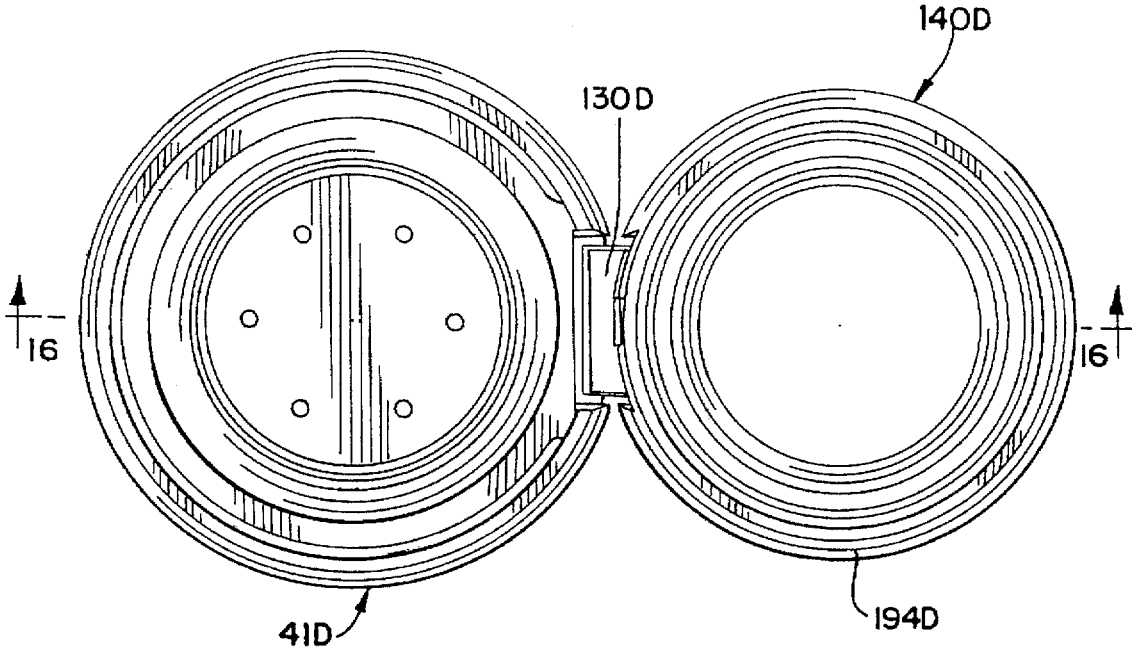
FIG. 15 is a plan view of the cartridge shown in FIG. 14.
Figure 16:
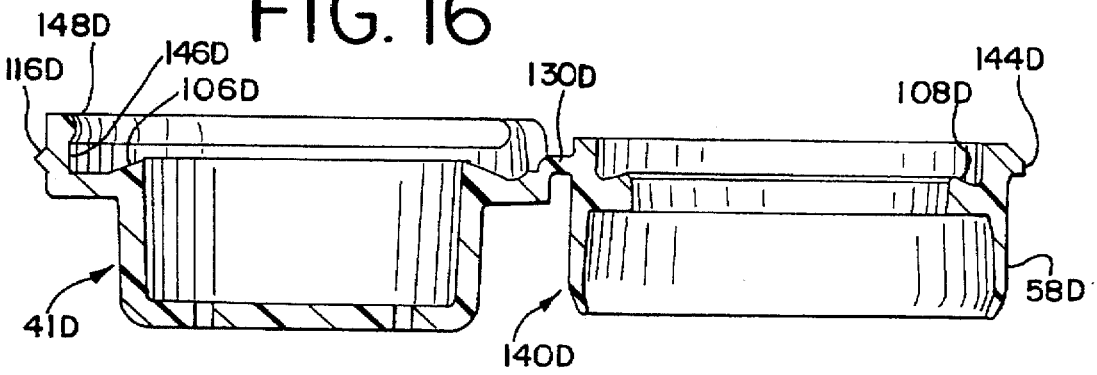
FIG. 16 is a cross-sectional view taken generally along the plane 16—16 in FIG. 15.

Together, the body 140D, valve 46D, and baffle 41D define a standardized cartridge. As illustrated in FIGS. 14–16, the body 140D and baffle 41D of the cartridge are initially fabricated in an "open" condition in which the body 140D and baffle 41D are molded as a unitary structure. In the preferred embodiment illustrated, the body 140D and 41D are molded together from a suitable thermoplastic material as a unitary structure with a hinge 130D (FIGS. 15 and 16) extending between, and connecting, the body 140D and baffle 41D. The baffle 41D is molded with a central, upper baffle plate 122 having a plurality of dispensing apertures 124D in a circular locus.

Figure 13:
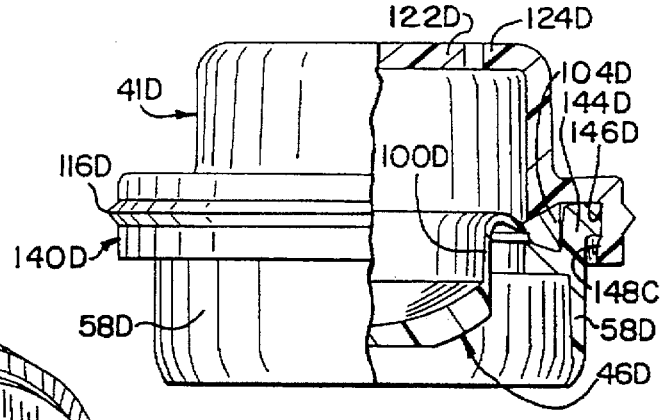
FIG. 13 is a side elevational view, partly in cross section, taken generally along the plane 13—13 in FIG. 12.

The cartridge also includes the flexible, resilient, slit-type dispensing valve 46D (FIG. 11) which is mounted in the body 140D and retained therein by the baffle 41D when the cartridge is in the closed configuration (FIGS. 11 and 13).

The valve 46D is identical with the first embodiment valve 46 described above with reference to FIGS. 1–5. The valve 46D includes a skirt 100D and a peripheral flange 104D which has a generally dovetail shape transverse cross section.

Figure 12:
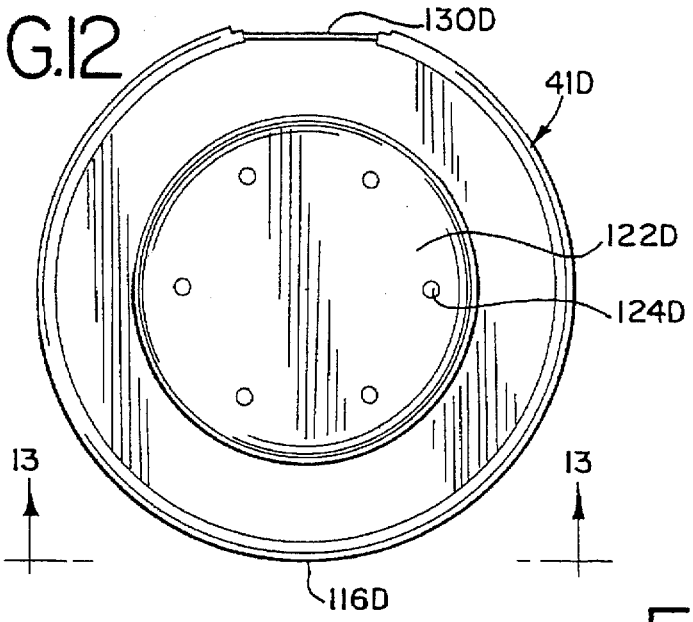
FIG. 12 is a plan view of the cartridge used in the fifth embodiment illustrated in FIG. 11.

The valve 46D is disposed in the cartridge body 140D and is clamped therein by the baffle 41D which is closed over the top of the valve 46D to form the fully assembled cartridge as shown in FIGS. 11–13.

To accommodate the seating of the valve 46D in the cartridge, the underside of the cartridge baffle 41D defines an annular, downwardly facing, angled clamping surface 106D (FIGS. 11 and 16) for engaging the top of the valve flange 104D.

The bottom of the valve flange 104D is engaged by an annular shoulder in the body 140D which defines an upwardly angled seating surface 108D (FIGS. 11 and 16).

The spacing between the clamping and seating surfaces 106D and 108D, respectively, increases with increasing radial distance from the center. Such a configuration defines a cavity with a transverse cross section having a dovetail shape which generally conforms to the shape of the valve flange 104D.

This clamping arrangement securely holds the valve 46D in the cartridge body 140D without requiring special internal support structures or bearing members adjacent the skirt 100D. This permits the region adjacent the valve skirt 100D to be substantially open, free, and clear so as to accommodate movement of the valve skirt 100D.

When the valve 46D is properly mounted within the body 140D as illustrated in FIG. 15, the valve 46D is recessed relative to the top part of the cartridge baffle 41D. This affords substantial room for the valve 46D to articulate upwardly to the open, dispensing position (analogous to the open position of the valve 46 in FIG. 5). As explained previously with respect to the first embodiment of the closure 40 illustrated in FIGS. 1–5, when the product is dispensed through the valve 46D, the valve is displaced outwardly from the recessed position.

The cartridge body 140D and baffle 41D have exterior configurations permitting the baffle and body to be held together in the closed configuration (FIGS. 11–13). In particular, the body 140D has an annular bead 144D (FIG. 18) extending around the periphery of the upper edge of the body (except at the hinge 130D where the bead 144D is interrupted). The baffle 41D defines an annular groove 146D and bead 148D (FIGS. 11, 13, and 16) for receiving the body bead 144D in a snap-fit engagement when the baffle 41D is closed over the installed valve 46D.

The closed cartridge (comprising the body 140D, baffle 41D, and valve 46D) is adapted to be engaged with the closure base 50D. To this end, the baffle 41D has an outwardly projecting, annular bead 116D (FIGS. 11–15) for being received in the base groove 66D (FIG. 11) in a snap-action engagement.

The body 140D includes an annular seal wall 58D for sealing against the inner edge of the container 42D.

The product within the container 42D can be dispensed from the container 42D by squeezing the container sufficiently to force the product through the valve 46D. Typically, this is effected by first inverting or tilting the container 42D so that the valve 46D is oriented to discharge generally downwardly. Typically, the product within the container flows downwardly, under the influence of gravity, and fills the container neck region. The product flows against the inside of the valve 46D. The valve 46D is preferably designed so that the weight of the product will not deflect the valve outwardly under normal, static conditions.

However, if the internal pressure within the containers is increased sufficiently by squeezing the container, then the increased pressure (which could also include the weight of the liquid within the container if the container was inverted) will deflect the valve central wall outwardly and open the valve.

A variety of different sizes and shapes of containers can be readily provided with a closure 40D having a standardized cartridge. The cartridge, including the valve 46D, can be provided in one, universal design having a standard shape and standard dimensions. The inside of the closure base 50D can be provided with a receiving region of a standard shape and size for the standard cartridge. Thus, only the skirt of the base 50D need be changed as necessary to accommodate a container neck having a particular size and shape. (The seal wall 58D could be omitted in appropriate applications so that a standard, small diameter cartridge (comprising the body 140D, valve 46D, and baffle 41D) could fit in a variety of larger necks of different containers.)

Further, the use of a standard cartridge with a standard valve permits the use of a single manufacturing process to assemble the valve in the cartridge. The cartridge can thereafter be readily handled at a high rate of speed by automatic machinery which installs the cartridge in the closure base 50D. This eliminates the need for directly handling a small, flexible valve during installation in a larger closure base 50D.

The use of a unitary cartridge (which includes the unitary body, hinge, and baffle and the separate valve) minimizes the number of separate parts that must be handled. Further, the snap-engagement of the cartridge baffle 41D with the cartridge body 140D permits a relatively rapid and efficient assembly process for capturing the valve 46D. Subsequently, the snap-fit engagement of the cartridge in the closure base 50D accommodates relatively high speed production with a minimum product reject rate.

Further, the use of a separate cartridge easily accommodates the creation of a multi-color closure. The cartridge can be fabricated in one color, and the closure housing can be molded in another color.

If desired, the cartridge baffle 41D or the base 50D could be provided with a hinged lid or cap (not illustrated) similar to the lid 128B shown in FIG. 9. Alternatively, a separate, completely removable lid could be provided.

It will be readily observed from the foregoing detailed description of the invention and from the illustrations thereof that numerous other variations and modifications may be effected without departing from the true spirit and scope of the novel concepts or principles of this invention.

What is claimed is:

1. A closure for a container having an opening, said closure comprising:

a base for mounting to said container around said opening;

a dispensing valve disposed across said base and defining an orifice which opens to permit flow therethrough in response to increased pressure within said container and closes to shut off flow therethrough upon removal of the increased pressure; and a dispersion baffle on said base outwardly of said valve, said baffle defining a plurality of dispensing apertures.

2. The closure in accordance with claim 1 in which said base, valve, and baffle are separate structures; and said baffle is in a snap-fit engagement with said base to clamp said valve between said baffle and base.

3. The closure in accordance with claim 1 in which said closure includes a lid hinged to said base for movement between a closed position covering said baffle and an open position in which said baffle is uncovered.

4. The closure in accordance with claim 1 in which said baffle is a unitary extension of said body.

5. The closure in accordance with claim 1 in which said closure further includes a body in a snap-fit engagement with said baffle to clamp said valve between said body and baffle;

said body, baffle, and valve cooperatively define a cartridge; and said cartridge is in a snap-fit engagement with said base for being disposed across said container opening.

6. The closure in accordance with claim 5 in which said baffle is hinged to said body.

7. The closure in accordance with claim 5 in which said baffle is in a snap-fit engagement with said base; and said body is engaged with said base.

8. The closure in accordance with claim 5 in which said body is in a snap-fit engagement with said base.

9. The closure in accordance with claim 1 in which said dispensing apertures in said dispersion baffle are arranged on a circular locus around a solid, central portion.

10. The closure in accordance with claim 1 in which said valve includes an annular flange; and said closure includes a pair of generally opposed first and second clamping surfaces for clamping said valve flange.

11. The closure in accordance with claim 10 in which said first and second clamping surfaces are defined by said base and dispersion baffle, respectively.

12. The closure in accordance with claim 10 in which said closure further includes a body in a snap-fit engagement with said dispersion baffle for clamping said valve between said baffle and said body;

said body defines said first clamping surface and said dispersion baffle defines said second clamping surface;

said body, valve, and baffle cooperatively define a cartridge; and said cartridge is in a snap-fit engagement with said base.

13. The closure in accordance with claim 1 in which said baffle is a unitary extension of said base and said closure further includes a body in snap-fit engagement with said base for clamping said valve against said baffle.

14. A closure for a container having an opening, said closure comprising:

a base for mounting to said container around said opening;

a dispensing valve which has an annular flange, which is disposed across said base, and which defines an orifice which opens to permit fluid flow therethrough in response to increased pressure within said container and closes to shut off fluid flow therethrough upon removal of the increased pressure; and a dispersion baffle on said base outwardly of said valve, said baffle defining a plurality of dispensing apertures, said baffle including a peripheral sidewall having a clamping surface engaging said valve flange.

15. The closure in accordance with claim 14 in which said dispersion baffle apertures are arranged on a circular locus around a solid, central portion.

16. The closure in accordance with claim 15 in which said valve includes a resilient wall having a pair of equal length intersecting slits which define said orifice;

said base, valve, and baffle each has a generally circular configuration and are aligned along a common longitudinal axis;

the intersection of said valve slits lies on said longitudinal axis in registry with the center of said locus of said baffle apertures; and said dispersion baffle central portion has a diameter greater than the length of each of said slits.

17. The closure in accordance with claim 14 in which said baffle is a unitary extension of said base and said closure further includes a body in snap-fit engagement with said base for clamping said valve against said baffle.

* * * * *